United States Patent [19]

Rubano

[11] 4,331,098

[45] May 25, 1982

[54] TENNIS SCORE KEEPER

[76] Inventor: Aldo Rubano, c/o George Spector, 3615 Woolworth Building, 233 Broadway, New York, N.Y. 10007

[21] Appl. No.: 728,209

[22] Filed: Sep. 30, 1976

[51] Int. Cl.[3] ..... A63F 1/18; A63B 49/00

[52] U.S. Cl. ..... 116/225; 273/DIG. 26; 235/1 B

[58] Field of Search ..... 116/120, 135, 222, 225; 273/73 R, DIG. 26; 235/1 B, 90, 123

[56] References Cited

U.S. PATENT DOCUMENTS

| | | | |
|---|---|---|---|
| 448,878 | 3/1891 | Clarke | 273/73 R |
| 1,026,433 | 5/1912 | DeForest | 235/1 B |
| 1,468,143 | 9/1923 | Eldridge | 235/1 B |
| 1,668,389 | 5/1928 | Vigneron | 235/123 X |
| 1,714,929 | 5/1929 | Smith | 235/123 X |
| 2,702,954 | 3/1955 | Cline et al. | 116/120 |
| 2,704,048 | 3/1955 | Perier | 235/123 X |
| 3,122,851 | 3/1964 | Sepe | 116/120 |
| 3,584,597 | 6/1971 | Simmons | 116/135 X |
| 3,777,699 | 12/1973 | Pfleger | 116/120 |
| 3,936,963 | 2/1976 | Chan | 116/120 |
| 3,986,715 | 10/1976 | Glick | 116/135 X |

*Primary Examiner*—Daniel M. Yasich

[57] ABSTRACT

A small sized device is disclosed for keeping score of a tennis match, and which can be conveniently carried either around a player's wrist, mounted on a racquet or the like; the score keeper including a frame on which is imprinted a row of point scores and a row of game scores along which arrows for each player are slidable.

1 Claim, 13 Drawing Figures

TENNIS SCORE KEEPER

This invention relates to a score keeper for a tennis match.

A principal object of the present invention is to provide a tennis score keeper which can be conveniently carried by a tennis player while playing, and which eliminates the necessity of trying to remember the scores while concentrating on the game being played, so to overcome the situation of arguments between players concerning a score.

Another object is to provide a tennis score keeper which is small so as to be not obtrusive or cumbersome, and which can be carried either on a wrist bracelet, in a pocket or secured on the racquet handle.

Other objects are to provide a tennis score keeper which is simple in design, inexpensive to manufacture, rugged in construction, easy to use and efficient in operation.

These and other objects will be readily evident upon a study of the following specification and the accompanying drawing wherein.

Figures 1, 2, 3, 4, 5, 5A, 5B, 6, 7, 8, 9, 10, 11:
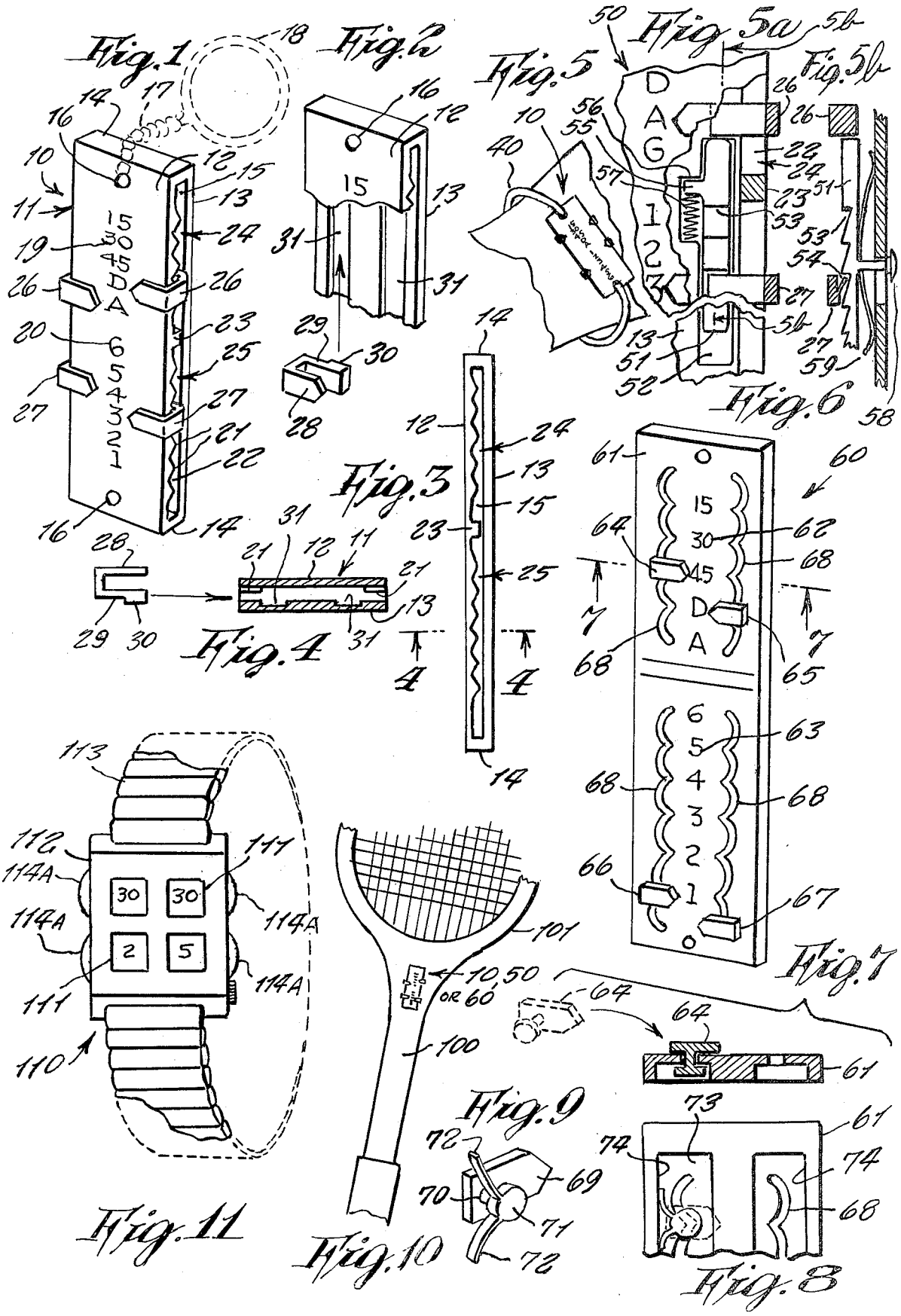
FIG. 1 is a perspective view of the invention shown incorporated on a key chain.
FIG. 2 is a fragmentary perspective view thereof.
FIG. 3 is a side edge view of the device.
FIG. 4 is a cross-section on line 4—4 of FIG. 3.
FIG. 5 illustrates the device incorporated on a wrist bracelet.

FIG. 5*a* shows a modified design of the invention in which a game score is automatically moved ahead when a point scoring arrow moves from an advantage position to a game winning position.

FIG. 5*b* is a cross sectional view on line 5*b*—5*b* of FIG. 5*a*.

FIG. 6 shows another modified design of the device.

FIG. 7 is a cross-sectional view on line 7—7 of FIG. 6.

FIG. 8 is a fragmentary rear view thereof.

FIG. 9 is a perspective view of an arrow component thereof.

FIG. 10 shows a score keeper mounted on a racquet handle.

FIG. 11 shows yet another design of the invention incorporated with a reversible wrist band of a watch.

Referring now to the drawing in greater detail, and more particularly to FIGS. 1 to 4 at this time, the reference numeral 10 represents a tennis score keeper according to the present invention wherein there is a one piece frame 11 molded of plastic and which comprises a flat sleeve having front and rear panels 12 and 13 connected by narrow opposite end walls 14, so to surround a thin, flat central space 15. A hole 16 near each opposite end of the frame serves for connection to a key chain 17 fitted with key ring 18. A front side of the panel 12 is imprinted with a row of scoring points 19 and another row of game numerals 20 for scoring the number of games in a tennis match.

The rear side of the front panel 12 is provided adjacent each side edge with a row of V-shaped teeth 21 with notches 22 therebetween. A projection 23 along a center of the row divides the row of teeth into two groups 24 and 25.

Along each side edge of the front panel 12, there are two pointers 26 and 27 each one of which is of U-shape so to include an arrow 28 positioned against a front side of the panel and a leg 29, that is parallel to the arrow and which fits inside the space 15 between the panels. The leg 29 includes a rearward extension 30 for sliding in a groove 31 formed on the inner side of the rear panel 13. Both pointers are slidable along the side edge of the frame so to move from one notch 22 to another. One pointer is slidable across the teeth of group 24, while the other pointer is slidable across the teeth of group 25, the projection 23 serving as a stop so to confine one pointer for pointing to the points score, and confining the other pointer for pointing to the game score.

The plastic material of the frame is very slightly resilient so that the front and rear panels bow slightly apart in order to allow the pointer leg 29 to slide past each tooth, when a pointer position is manually changed. At other times, the teeth serve to prevent the pointers to accidentally slide away from an intended position. It will be noted that in this construction the extension 30 slidable in groove 31 prevents the pointer to accidentally fall out of the frame.

In this invention, both pointers along one side edge of the frame are a same color, while the two pointers on the opposite side edge of the frame are of a color that is same to each other but which differs from the color of the two pointers along the opposite edge. Thus the two pointers on each side edge keep a score for one player or team.

In FIG. 5, the tennis score keeper 10 is shown attached to a wrist bracelet 40 so to be handy to a player.

In FIGS. 5*a* and 5*b* a modified design of the invention 50 includes an extra notch 22 in the tooth group 24 for an extra point identified with a "G" on the front side of the front panel, so that when a player wins a game, he simply moves the point-scoring pointer 26 down to "G" and which causes movement of the pointer 27 to a next game scoring numeral 20 due to a mechanism described below. Thus a player confines all his manual adjustments to (see FIG. 5*a*) the pointer 26 only. Game numbers increase from pointer 26 to pointer 27 thus movement of 26 towards 27 increased the game score.

This is accomplished by the pointer 26 abutting an upper end of a bar 51 when moved from "D" to "G" position, the bar 51 thus being slid in a groove 52 on the inner side of rear wall 13. A row of ratchet teeth 53 along the bar engage a detent tooth 54 on the pointer 27, so that regardless of the position of the pointer 27, it will be downwardly pushed by one of the teeth 53, engaging detent 54 on pointer 27, a distance of one space so that the pointer is moved to point at a next higher, game score numeral. The teeth in groups 24 and 25 serving to retain the pointers at each successive indicia. A projection 55 on the bar inside a notch 56 of the rear panel 13 is urged by a return coil spring 57 so to return the bar back to its start position after advancing the pointer, so to be ready for a next game of the same match.

In order that the pointer 27 can be slided upwardly at the end of the games for a new match, the bar 51 is rearwardly pulled so the ratchet teeth clear the detent tooth 54 thus allowing the pointer to move upward. A knob 58 integral with the bar projects outward of a rear of the frame so to be pulled against the action of a leaf spring 59 when the bar is intended to clear the pointer 27.

It is to be noted that in the design of 50, the game scoring numerals are in reverse to that shown in FIG. 1.

In FIGS. 6 to 8 another design 60, the score keeper comprises a plastic panel 61 having points 62 and game score 63 imprinted on a front side. A set of four plastic pointers 64,65,66 and 67, similar to the above-described pointers, are slidable along scallop-shaped slots 68 in the panel so to advance between positions. Each pointer includes an arrow 69 integral with stem 70 extending through the slot, an enlarged head 71 and flexible extensions 72. The head travels in a groove 73 formed on a rear side of the panel, and the extensions bear against groove side edge 74. The spring like extensions serve to maintain the pointers at a set position by preventing them to accidentally slide away, and they also serve to maintain the pointer from rotating in the slot.

In FIG. 10, the above described tennis score keeper is shown mounted on a handle 100 of a tennis racquet 101.

In FIG. 11, another design 110 of the invention is shown in which point and game scores are visible in windows 111 of a rear wall of a hollow case 112 which may have a watch face (not shown) on its opposite side. By reversing the stretchable watch strap 113, the care can be carried to selectively display a time or on the opposite side could be used in playing a tennis match. Wheels 114 each having point score indicia 0, 15, 30, 40, D and A and game score indicia 0, 1, 2, 3, etc (as seen in FIG. 11) are rotatably mounted in case 112 adjacent the rear wall so that manual movement of the wheels can be individually effected by rotating the portion of the wheels 114A extending outwardly of the case 112. The wheels are mounted with sufficient frictional resistance against rotation whereby the wheels will not move unless the operator applies sufficient manual pressure. Optionally, stops can be employed of conventional nature (not shown) to retain the wheels at a desired point. It should be understood that a case 112 can be employed that does not also have a time mechanism.

While various changes may be made in the detail construction, it is understood that such changes will be within the spirit and scope of the present invention, as is defined by the appended claims.

What is claimed is:

1. A tennis score keeper comprising an elongated frame having front and back sides with an internal cavity therebetween wherein the front side has enscribed thereon indicia related to points and games scored in a tennis match, said indicia being in alignment along the longitudinal axis of said frame in combination with two transversely spaced pairs of opposing similar indicators s slidably mounted on said frame with the indicia centrally therebetween, wherein each indicator includes a resilient leg and a spaced opposing pointer directed transversely towards the indicia, including a pair of guide slots communicating with said cavity transversely spaced on each side of said indicia and extending generally longitudinally of said indicia, each indicator mounted slidably in each slot with said leg extending into said cavity said frame and indicators including coacting abutting portions for affixing each indicator at spaced selected locations wherein each of said pointers are retained in transverse alignment with a selected indicia, said abutting portions including a frame surface having regularly spaced notches for engaging each said indicators leg and pointer corresponding to said selected locations in combination with further means slidably mounted on said frame between each pair of indicators whereby longitudinal movement of one of said indicators from a selected indicia towards the other of said indicators will cause a predetermined longitudinal movement of the other of said indicators thereby automatically adjusting the game score to correspond with the point scoring.

* * * * *